United States Patent [19]

Weyer

[11] Patent Number: 5,020,417

[45] Date of Patent: Jun. 4, 1991

[54] ROTARY SERVO ACTUATOR WITH INTERNAL VALVE

[76] Inventor: Paul P. Weyer, 1462 Blake St., Enumclaw, Wash. 98022

[21] Appl. No.: 568,277

[22] Filed: Aug. 15, 1990

[51] Int. Cl.[5] ..... F15B 9/12; F15B 9/14

[52] U.S. Cl. ..... 91/375 R; 91/380; 74/89.15; 74/424.8 R

[58] Field of Search ..... 91/375 R, 380, 381, 91/467; 92/31, 33, 136; 74/89.15, 424.8 R

[56] References Cited

U.S. PATENT DOCUMENTS

| | | | |
|---|---|---|---|
| 2,742,021 | 4/1956 | Geyer | 91/380 |
| 2,980,067 | 4/1961 | Millard | 91/380 X |
| 3,310,284 | 3/1967 | Inaba et al. | 91/380 X |
| 4,313,367 | 2/1982 | Weyer | 92/33 |
| 4,422,366 | 12/1983 | Weyer | 92/33 X |
| 4,683,767 | 8/1987 | Weyer | 92/33 X |
| 4,838,103 | 6/1989 | Weyer | 92/33 X |
| 4,846,007 | 7/1989 | Weyer | 92/33 X |
| 4,858,486 | 8/1989 | Weyer | 92/33 X |

OTHER PUBLICATIONS

Sperbeck, A. J., "Totally Digital Valves Fully Utilize Hydraulic Servos", *Hydraulics & Pneumatics*, pp. 65–66, Dec., 1987.

Budzilovich, P. N., "Use Electrohydraulic Stepping Motors for All-Digital Drives", *Control Engineering*, pp. 82–88, Jan., 1970.

Description of the "Olsen" Rotary Electro-Hydraulic Pulse Drive, Olsen Controls, Inc., two pages.

Schneider, Richard (ed.), "Fluid Power/Ideas and Applications", *Hydraulics & Pneumatics*, pp. 18 and 20, Jan., 1987.

*MTS Brochure*, "A Family of Actuators to Power most any Controlled Positioning of Velocity Requirement", MTS Systems Corporation, pp. 1–6.

*Primary Examiner*—John T. Kwon
*Assistant Examiner*—George Kapsalas
*Attorney, Agent, or Firm*—Seed and Berry

[57] ABSTRACT

A fluid-powered servo actuator having a body, an annular piston, and a shaft extending co-axially therewithin. The shaft has an interior chamber located within the body with two fluid channels extending to the chamber in which the piston is mounted. One channel communicates with each side of the piston. A valve spool is positioned in the shaft chamber, and a cam follower or threads are used to longitudinally move the valve spool therewithin in response to its selected rotation. The valve spool has a pair of valve lands which, when in a neutral position, close the two channels. When the valve spool is moved longitudinally, pressurized fluid is communicated with one or the other of the channels to cause the piston to move longitudinally. Splines or rollers convert the longitudinal movement of the piston into rotational movement of the shaft. The cam follower or threads cause the resulting rotational movement of the shaft to move the valve spool back to the neutral position when the shaft has rotated by an amount and in a direction corresponding to the selected amount and direction the valve spool was rotated.

29 Claims, 3 Drawing Sheets

ROTARY SERVO ACTUATOR WITH INTERNAL VALVE

TECHNICAL FIELD

The present invention relates generally to actuators, and more particularly, to a hydraulic rotary actuator controlled by a spool valve.

BACKGROUND OF THE INVENTION

To provide increased control of hydraulic motors, a device called a hydraulic servo was created. Frequently, the hydraulic servo is driven by an electronic stepper motor. Such hydraulic servos have three separate components: a stepper motor, a rotary valve driven by the stepper motor, and a hydraulic motor which receives hydraulic fluid from the rotary valve. In effect, the action of the stepper motor is hydraulically amplified by the hydraulic motor to provide a high-level output. Usually, the hydraulic servo is built with the three separate stepper motor, rotary valve and hydraulic motor components arranged in an end-to-end, generally coaxial relationship which results in a relatively long device. These hydraulic servos also have a relatively complex design with many long fluid passages running between the rotary valve and the hydraulic motor which increases their cost of manufacture.

It will, therefore, be appreciated that there has been a significant need for a hydraulic servo with a simpler design which is less expensive to manufacture, and with a more compact design. Further, it is desirable to produce a hydraulic servo which utilizes a fluid-powered helical actuator. Such an actuator uses a cylindrical body with an elongated rotary output shaft extending co-axially within the body. The shaft has an end portion which provides the rotary drive output. The actuator has an elongated piston sleeve disposed between the body and the shaft, with the shaft co-axially extending therethrough. Helical splines, balls in helical grooves, or rollers in helical grooves are used for transmitting torque between the piston sleeve and the body and between the piston sleeve and the shaft to produce rotation of the shaft in response to axial movement of the piston sleeve. Such an arrangement produces a relatively high torque rotary output from a simple linear input.

It is desirable to create a hydraulic servo which utilizes a helical actuator of the type just described using a rotary valve for control which can be driven manually, by a stepper motor or by other means. The resulting servo actuator should have a design which is more compact, simpler and less expensive to manufacture. The present invention fulfills these needs, and further provides other related advantages.

SUMMARY OF THE INVENTION

The present invention resides in a fluid-powered servo actuator connectable to an external supply of pressurized fluid. The servo actuator includes a body having a longitudinal axis and first and second ends, and a drive member extending longitudinally and generally co-axially within the body. The body and drive member define an annular chamber between the body and the drive member.

The drive member has first and second ends with the member first end toward the body first end and the member second end toward the body second end. The drive member is supported for rotational movement relative to the body, and the member second end is adapted for coupling to an external device to provide rotational drive thereto.

The drive member has an interior chamber extending longitudinally and generally co-axial therein and interior of the body. The drive member includes a first fluid channel extending between the member chamber and the annular chamber. The first channel has an outward and the annular chamber. The first channel has an outward port position for fluid communication with the annular chamber and an inward port position for fluid communication with the member chamber. The drive member further includes a second fluid channel extending between the member chamber and the annular chamber. The second channel has an outward port position for fluid communication with the annular chamber and an inward port position for fluid communication with the member chamber.

An annular piston is mounted within the annular chamber between the outward ports of the first and second channels for reciprocal longitudinal movement within the body in response to the selective application of pressurized fluid to a first side thereof toward the body first end to drive the piston toward the body second end, or to a second side thereof toward the body second end to drive the piston toward the body first end. The piston has a central aperture through which the drive member projects.

The servo actuator has a linear-to-rotary means for translating longitudinal movement of the piston toward one of the body first or second ends into clockwise relative rotational movement between the drive member and the body, and for translating longitudinal movement of the piston toward the other of the body first or second ends into clockwise relative rotational movement between the drive member and the body.

A valve spool is positioned in the member chamber. The valve spool is rotatable within the member chamber and longitudinally movable therewithin toward the member first and second ends from a neutral position. The valve spool has a first valve land toward the member first end and a second valve land towards the member second end. The first and second valve lands are in sealing engagement with the drive member as the valve spool moves within the member chamber.

The first and second valve lands divide the member chamber into a first fluid chamber to a side of the first valve land toward the member first end, a second fluid chamber to a side of the second valve land toward the member second end, and a middle fluid chamber between the first and second valve lands. The first valve land is positioned to close the inward port of the first channel, and the second valve land is positioned to close the inward port of the second channel when the valve spool is in the neutral position.

The valve spool is movable from the neutral position toward the member first end to place the inward port of the first channel in fluid communication with the middle chamber, and the inward port of the second channel in fluid communication with the second chamber. The valve spool is also movable from the neutral position toward the member second end to place the inward port of the first channel in fluid communication with the first chamber and the inward port of the second channel in fluid communication with the middle chamber.

The servo actuator includes a fluid supply channel in fluid communication with the middle chamber and a fluid supply port connectable to the external supply of pressurized fluid. Also included is a drain channel in fluid communication with both the first and second chambers and a drain port for discharge of fluid in the first chamber in response to movement of the piston toward the body first end, and for discharge of fluid in the second chamber in response to movement of the piston toward the body second end.

Control means are provided for selectively moving the valve spool longitudinally within the member chamber from the neutral position toward the member first end to apply pressurized fluid in the middle chamber to the first channel, or toward the member second end to apply pressurized fluid in the middle chamber to the second channel in response to rotation of the valve spool by a selected amount in a selected direction relative to the drive member. The control means also provides for longitudinally moving the valve spool back toward the neutral position and positioning the valve spool in the neutral position in response to the resulting rotational movement of the drive member upon the drive member rotating by an amount and in a direction corresponding to the selected amount and direction the valve spool was rotated.

The servo actuator further includes actuating means for selectively rotating the valve spool relative to the body by the selected amount and direction. When the actuation means is selectively operated, the valve spool is rotated relative to the body, and hence the drive member, to cause the control means to move the valve spool longitudinally relative to the drive member from the neutral position. In a preferred embodiment of the invention, the actuation means is a gear attached to the valve spool and a corresponding drive gear in engagement therewith. The drive gear is selectively rotatable by a manual handwheel, a stepper motor or any other device. In one embodiment, the spool gear and the drive gear are positioned in a gear chamber which is in fluid communication with the drain channel for lubrication by the discharged fluid carried by the drain channel.

In a preferred embodiment of the invention, the fluid supply channel extends longitudinally within the valve spool between the middle chamber and the fluid supply port. The drain channel also extends longitudinally within the valve spool. In another embodiment, the drain channel is formed in a sidewall of the drive member.

The member chamber has an open end at the member first end and a closed end toward the member second end. The valve spool projects longitudinally from within the member chamber through the chamber open end to a position exterior of the body at the body first end. The valve spool has a valve spool portion exterior of the body at which the fluid supply port is located. A swivel connector is positioned on the valve spool exterior portion in fluid communication with the fluid supply port. In one embodiment with the drain channel extending longitudinally within the valve spool, the swivel connector is also in fluid communication with a drain port.

Other features and advantages of the invention will become apparent from the following detailed description, taken in conjunction with the accompanying drawings.

DETAILED DESCRIPTION OF THE INVENTION

Figure 1:
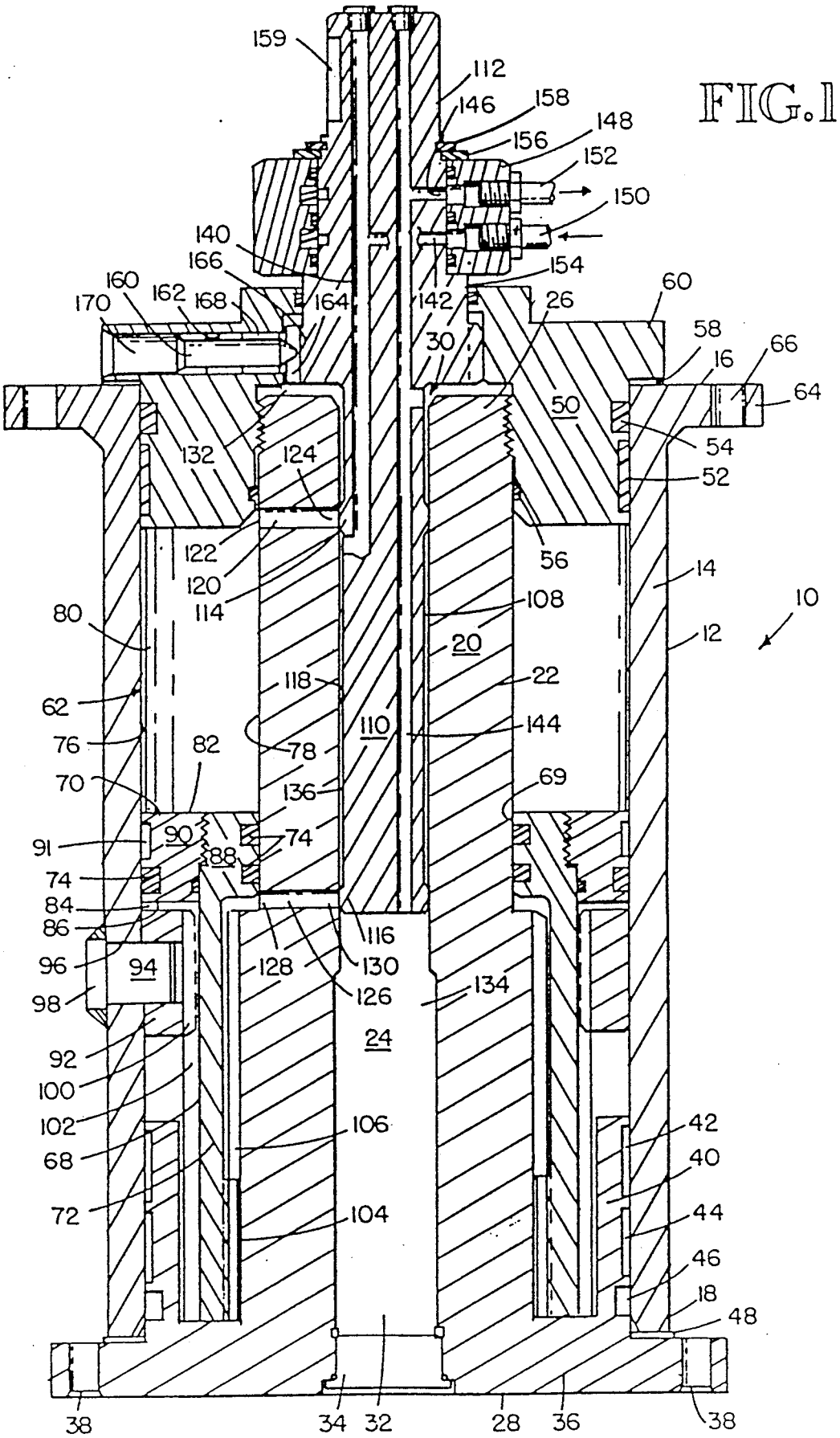
FIG. 1 is a side elevational, sectional view of a fluid-powered rotary servo actuator embodying the present invention.

As shown in the drawings for purposes of illustration, the present invention is embodied in a fluid-powered servo actuator, indicated generally by reference numeral 10. The servo actuator 10 includes an elongated housing or body 12 having a cylindrical sidewall 14, and first and second ends 16 and 18, respectively. An elongated rotary output shaft 20 is co-axially positioned within the body 12 and supported for rotation relative to the body. The shaft 20 has a generally cylindrical central portion 22, which defines an interior chamber 24. The shaft chamber 24 extends longitudinally and generally co-axially within the shaft 20 between a first end 26 of the shaft toward the body first end 16 and a second end 28 of the shaft toward the body second end 18. The shaft chamber 24 has an open end 30 at the shaft first end 26 and a closed end 32 at the shaft second end 28. A fluidsealing cap 34 provides the closure at the closed end 32.

The shaft 20 has an integral, radially extending end flange 36 positioned at the shaft second end 28 which extends radially outward beyond the body sidewall 14. The shaft end flange 36 has a plurality of circumferentially spaced-apart attachment holes 38 for attachment of the shaft 20 to an external device (not shown) to which rotational output drive is to be provided by the servo actuator 10.

A cylindrical sleeve 40 formed as an integral part of the shaft end flange 36 is co-axially positioned with the body 12 and projects into the body inward of the body sidewall 14 immediately adjacent thereto. The sleeve 40 is circumferentially grooved to retain two rows of radial bearings 42 and 44, and a fluid seal 46. The seal 46 provides a fluid-tight seal between the shaft 20 and the body sidewall 14 at the body second end 18. An annular thrust bearing 48 is positioned between the second end 18 of the body sidewall 14 and the shaft end flange 36.

An annular nut 50 is threadably attached to the shaft central portion 22 at the shaft first end 26 for rotation with the shaft central portion during operation of the servo actuator 10. The annular nut 50 is co-axially positioned with the body 12 and projects into the body 12 inward of the body sidewall 14 immediately adjacent thereto. The annular nut 50 is circumferentially grooved to retain a row of radial bearings 52 and a fluid seal 54. The seal 54 provides a fluid-tight seal between the shaft 20 and the body sidewall 14 at the body first end 16. A seal 56 is also provided between the annular nut 50 and the shaft central portion 22. An annular thrust bearing 58 is positioned between the first end 16 of the body sidewall and an integral, radially extending flange portion 60 of the annular nut 50. The flange portion 60 is located longitudinally outward of the body first end 16 and extends radially outward substantially co-extensive with the body sidewall 14. The shaft end flange 36 and the flange portion 60 of the annular nut 50 operate in conjunction with the thrust bearings 48 and 58 to hold the shaft central portion 22 in place within the body 12 against axial thrust. With this arrangement, the body 12 and the shaft 20 define an annular fluid-tight chamber 62.

The body 12 has an integral, radially extending end flange 64 positioned at the body first end 16 which extends radially outward beyond the body sidewall 14. The end flange 64 has a plurality of circumferentially spaced-apart attachment holes 66 for attachment of the body 12 to a support frame (not shown). It is to be understood that while the means for attaching the shaft 20 to an external device and for attaching the body 12 to a support frame are described as flanges 36 and 64, any conventional means of attachment may be used. Further, it is to be understood that the invention may be practiced with the shaft 20 rotatably driving the external device, or with the shaft being held stationary and the rotational drive being provided by rotation of the body 12.

The servo actuator 10 has a conventional linear-to-rotary conversion means. A piston sleeve 68 is co-axially and reciprocally mounted within the annular chamber 62. The shaft central portion 22 projects co-axially through a central aperture 69 in the piston sleeve 68. The piston sleeve 68 has a head portion 70 positioned toward the body first end 16, and a cylindrical sleeve portion 72 fixedly attached to the head portion and extending axially therefrom toward the body second end 18. The head portion 70 carries conventional seals 74 disposed between the head portion and a corresponding interior smooth wall portion 76 of the body sidewall 14 and a corresponding exterior smooth wall portion 78 of the shaft central portion 22 to divide the annular chamber 62 into a first fluid-tight compartment 80 to a first side 82 of the head portion toward the body first end 16 and a second fluid-tight compartment 84 to a second side 86 of the head portion toward the body second end 18. The smooth wall portions 76 and 78 have sufficient axial length to accommodate the full stroke of the head portion 70 within the body 12. Of course, the volumes of the compartments 80 and 84 change as the piston sleeve 68 reciprocates.

The head portion 70 has a two-piece construction formed by an inner portion 88 formed integral with the sleeve portion 72, and a piston ring 90 which extends about the inner portion and is threadably attached thereto for travel therewith during operation of the servo actuator 10. The piston sleeve 68 is slidably mounted within the annular chamber 62 for reciprocal movement, and undergoes longitudinal and rotational movement relative to the body as pressurized fluid is selectively applied to the compartments 80 and 84. A radial bearing 91 is carried by the piston ring 90.

Reciprocation of the piston sleeve 68 occurs when pressurized hydraulic oil or compressed air enters one or the other of compartments 80 or 84. As used hereinafter, "fluid" will refer to hydraulic oil, air or any other fluid suitable for use in operating the servo actuator. The application of pressurized fluid to the first compartment 80 produces axial movement of the piston sleeve 68 toward the body second end 18. The application of pressure to the second compartment 84 produces axial movement of the piston sleeve 68 toward the body first end 16. The servo actuator 10 provides relative rotational movement between the body 12 and the shaft 20 through the conversion of this linear movement of the piston sleeve 68 into rotational movement of the shaft.

The servo actuator 10 of FIG. 1 uses a ring gear 92 joined to the body sidewall 14 by a plurality of pins 94 which are circumferentially spaced apart the body sidewall 14 and extend through a corresponding plurality of ring gear fastening holes 96 in the body sidewall. The pins 94 each have a head 98 which is welded to the body sidewall 14.

The ring gear 92 has inner helical splines 100, and the piston sleeve 68 has outer helical splines 102 over a portion of its length which mesh with the ring gear helical splines. The piston sleeve 68 is also provided with inner helical splines 104 which mesh with helical splines 106 provided on the shaft central portion 22 toward the shaft second end 28. It is to be understood that while helical splines are shown in FIG. 1 and described herein, the principle of the invention is equally applicable to any form of linear-to-rotary motion conversion means. As will be described below, the embodiments of the servo actuator 10 shown in FIGS. 2 and 3 utilize a roller and groove arrangement.

As will be readily understood, reciprocation of the piston sleeve 68 occurs when pressurized fluid enters one or the other of the compartments 80 or 84. As the piston sleeve 68 linearly reciprocates in a longitudinal direction within the body 12, the outer helical splines 102 of the piston sleeve mesh with the inner helical splines 100 of the ring gear 92 to cause rotation of the piston sleeve. This linear and rotational movement of the piston sleeve 68 is transmitted through the inner helical splines 104 of the piston sleeves to the helical splines 106 of the shaft central portion 22 to cause the shaft 20 to rotate. Since longitudinal movement of the shaft 20 within the body 12 is restricted by the flanges 36 and 60 and the thrust bearings 48 and 58, all movement of the piston sleeve 68 is converted into rotational movement of the shaft 20. By selecting the slope and direction of turn used for the helical splines, the desired amount and direction of resulting rotary output of the shaft 20 can be produced.

The selected application of pressurized fluid to the compartments 80 and 84 is controlled by a valve spool 108. The valve spool 108 has a valve portion 110 positioned within the shaft chamber 24 and an exterior portion 112 which projects longitudinally from within the shaft chamber through the shaft chamber open end 30 to a position exterior of the body 12. The valve spool 108 is rotatable within the shaft chamber 24, and is also longitudinally movable within the shaft chamber toward the shaft first and second ends 26 and 28 from a neutral position. The valve spool is shown in the neutral position in FIG. 1.

The valve portion 110 has a first circumferential valve or land 114 projecting radially outward which is located toward the shaft first end and a second circumferential valve or land 116 projecting radially outward which is located toward the shaft second end. The first and second valve lands 114 and 116 are in sealing sliding engagement with an interior smooth wall portion 118 of the shaft chamber 24 as the valve spool 108 moves within the shaft chamber.

The shaft central portion 22 has a first fluid channel 120 toward the shaft first end 26 extending directly between the shaft chamber 24 and the annular chamber 62. The first channel 120 has an outward port 122 positioned for fluid communication with the first compartment 80 of the annular chamber 62 toward the shaft first end 26 and an inward port 124 position for fluid communication with the shaft chamber 24 toward the shaft first end. Similarly, the shaft central portion 22 has a second fluid channel 126 toward the shaft second end 28 extending directly between the shaft chamber 24 and the annular chamber 62. The second channel 126 has an outward port 128 position for fluid communication with the second compartment 84 of the annular chamber 62 toward the shaft second end 28 and an inward port 130 position for fluid communication with the shaft chamber 24 toward the shaft second end. The first valve land 114 is positioned to close the inward port 124 of the first channel 120 and the second valve land 116 is positioned to close the inward port 130 of the second channel 126 when the valve spool 108 is in the neutral position, as shown in FIG. 1.

The first and second valve lands 114 and 116 divide the shaft chamber 24 into three fluid chambers. A first fluid chamber 132 is defined to a side of the first valve land 114 toward the shaft first end 26, a second fluid chamber 134 is defined to a side of the second valve land 116 toward the shaft second end 28, and a middle fluid chamber 136 is defined between the first and second valve lands.

A fluid supply channel 140 extends longitudinally within the valve spool 108 between a fluid supply port 142 at the valve spool exterior portion 112, located exterior of the body 12, to the middle chamber 136. A drain channel 144 also extends longitudinally within the valve spool 108. The drain channel 144 is in fluid communication with both the first and second chambers 132 and 134 and extends to a return port 146 at the valve spool exterior portion 112, located exterior of the body 12. A swivel coupling 148 is rotatably mounted on the valve spool exterior portion 112, exterior of the body 12 to permit connection of the servo actuator 10 to stationary supply and return lines 150 and 152 of an external source of pressurized hydraulic fluid (not shown). If compressed air is used to operate the servo actuator 10, no return line is required and the "return" air can be exhausted to the atmosphere.

The swivel coupling 148 connects the fluid supply port 142 of the fluid supply channel 140 to the supply line 150 which carries pressurized hydraulic fluid from the external source and connects the return port 146 to the return line 152 which carries discharged hydraulic fluid to the external source. The swivel coupling 148 allows the valve spool 108 to be freely rotated during operation of the servo actuator 10 while connected to the stationary fluid lines 150 and 152 of the external source.

The swivel coupling 148 is mounted on the valve spool exterior portion 112 between a shoulder 154 thereof and a bearing ring 156 which is held in place by a clip 158. It is noted that during operation of the servo actuator 10 the valve spool 108 does move longitudinally within the shaft chamber 24 by a relatively small amount, hence the fluid lines 150 and 152 must be somewhat flexible to accommodate this longitudinal movement.

When the valve spool 108 is longitudinally moved from the neutral position toward the shaft first end 26 (i.e., upward when viewing FIG. 1), the inward port 124 of the first channel 120 is placed in fluid communication with the middle chamber 136, and the inward port 130 of the second channel 126 is placed in fluid communication with the second chamber 134. This results in the pressurized fluid in the middle chamber 136 being applied through the first channel 120 via its exterior port 122 to the first compartment 80 of the annular chamber 62 to the first side 82 of the piston head portion 70. The pressurized fluid causes the piston sleeve 68 to move toward the body second end 18 (i.e., downward). Since the second chamber 134 is placed in communication with the inward port 128 of the second channel 126, the fluid in the second compartment 84 is discharged via the external port 128 of the second channel through the second chamber 134 into the drain channel 144 by the action of the piston sleeve 68 moving toward the body second end 18. This movement of the piston sleeve 68 produces a counterclockwise rotation of the shaft 20 relative to the body 12 as viewed from the body first end 16. As will be described below, the rotation of the shaft 20 also causes the valve spool 108 to be returned to the neutral position.

When the valve spool 108 is longitudinally moved from the neutral position toward the shaft second end 28 (i.e., downward when viewing FIG. 1), the inward port 124 of the first channel 120 is placed in fluid communication with the first chamber 132, and the inward port 130 of the second channel 126 is placed in fluid communication with the middle chamber 136. In this instance, the pressurized fluid in the middle chamber 136 is applied via the external port 128 of the second channel 126 to the second compartment 84 of the annular chamber 62 to the second side 86 of the piston head portion 70, which causes the piston sleeve 68 to move toward the body first end 16 (i.e., upward). The fluid in the first compartment 80 is discharged via the exterior port 122 of the first channel 120 through the first chamber 132 into the drain channel 144 by the action of the piston sleeve 68 moving toward the body first end 16. This movement of the piston sleeve 68 produces a clockwise rotation of the shaft 20 relative to the body 12 as viewed from the body first end 16. The shaft rotation causes return of the valve spool 108 to the neutral position as will be described below. Of course, the direction and amount of rotation of the shaft 20 relative to the body 12 resulting from longitudinal movement of the piston sleeve 68 depends upon the lead and hand of the helical splines used for the piston sleeve, the ring gear 92 and the central shaft portion 22.

The longitudinal movement of the valve spool 108 within the shaft chamber 24, which results in rotation of the shaft 20 relative to the body 12 as described above, is accomplished by adjustably rotating the valve spool by a selected rotational amount and in a selected rotational direction. Such adjustable rotation of the valve spool 108 is usually accomplished by connection of the valve spool exterior portion 112 to a manually operable wheel or a stepper motor (not shown). A longitudinal key way 159 in the valve spool exterior portion 112 is provided to facilitate the connection. This rotation is converted to longitudinal movement of the valve spool 108 by a cam follower 160 mounted in a radial bore 162 in the flange portion 60 of the annular nut 50 which operatively engages a helical groove 164 formed in a grooved portion 166 of the valve spool exterior portion 112 located between the swivel coupling 148 and the body first end 16. The cam follower 160 is a pin with a tapered end to rollingly engage the sidewalls of the helical groove 164. Two sets of roller bearings 168 are disposed in the bore 162 about the cam follower 160 to facilitate its free rotation. A set screw 170 is provided to axially adjust the seating of the cam follower 160 in the helical groove 164.

The helical groove 164 used for the embodiment of FIG. 1 has a right-hand turn so that when a user of the servo actuator 10 rotates the valve spool 108 clockwise (when viewed from the body first end 16), the valve spool longitudinally moves from the neutral position toward the shaft second end 28 (i.e., downward) which produces a clockwise rotation of the shaft 20 relative to the body 12 as explained above. Counterclockwise rotation of the valve spool 108 longitudinally moves the valve spool from the neutral position toward the shaft first end 26 (i.e., upward), which produces a counterclockwise rotation of the shaft 20 relative to the body 12 as explained above. In the presently preferred body of the invention, the helical groove 164 is selected with a lead and hand such that when the user rotates the valve spool 108 by a selected amount and in a selected direction, the valve spool moves longitudinally within the shaft chamber 24 from the neutral position, either toward the shaft first end 26 to apply the pressurized fluid in the middle chamber 136 to the piston first side 82, or toward the shaft second end 28 to apply the pressurized fluid in the middle chamber to the piston second side 86, to rotate the shaft 20 by the same selected amount and selected direction as the valve spool was rotated.

For example, if the user turns the valve spool 108 by 30 degrees in a clockwise direction, the helical groove 164 longitudinally moves the valve spool toward the shaft second end 28 to produce clockwise rotation of the shaft 20. As mentioned above, the resulting rotation of the shaft 20 causes the valve spool 108 to be returned to the neutral position when the shaft has been rotated by 30 degrees.

Since the annular nut 50, hence the cam follower 160, rotate with the shaft 20, and assuming the valve spool exterior portion 112 is connected to a manually operable wheel or stepper motor which resists turning when not actuated by the user, as the shaft rotates the engagement of the cam follower 160 with the helical groove 164 will cause the valve spool 108 to move longitudinally back toward the neutral position. When the shaft 20 has rotated sufficiently to move the valve spool 108 back to the neutral position, the first and second valve lands 114 and 116 of the valve spool will be positioned to close the inward ports 124 and 130 of the first and second channels 120 and 126. When that occurs, pressurized fluid is no longer applied to the chambers 132 or 134, and all movement of the piston sleeve 68, and hence the shaft 20 and the valve spool 108, stops.

With the example described above, when the user turns the valve spool 108 by 30 degrees in a clockwise direction, the valve spool moves within the shaft chamber 24 toward the shaft second end 28 and the shaft 20 rotates clockwise by 30 degrees. Since the helical groove 164 has a right-hand turn, the resulting clockwise rotation of the shaft 20 by 30 degrees relative to the valve spool 108 causes the cam follower 160 to longitudinally move the valve spool toward the shaft first end 26 back to the neutral position. In such manner, it is possible to rotate the valve spool 108 by a selected amount in a selected direction using a relatively small torque and have the shaft 20 of the servo actuator 10 rotate by the same amount in the same direction with the high torque output of a helical actuator which is many times the torque the user applied to the valve spool.

By positioning of the valve spool 108 within the interior shaft chamber 24 rather than external of the body 12 and within its own valve body, a more simplified porting of fluid can be utilized. Also, by avoiding the use of a separate valve body for the valve spool 108, a simpler and more compact design is created which is more economical to manufacture and has a shorter overall length. The design incorporates a high-torque, rotary helical actuator using a piston sleeve and shaft arrangement. These advantages represent a significant improvement over prior art hydraulic servos.

Figure 2:
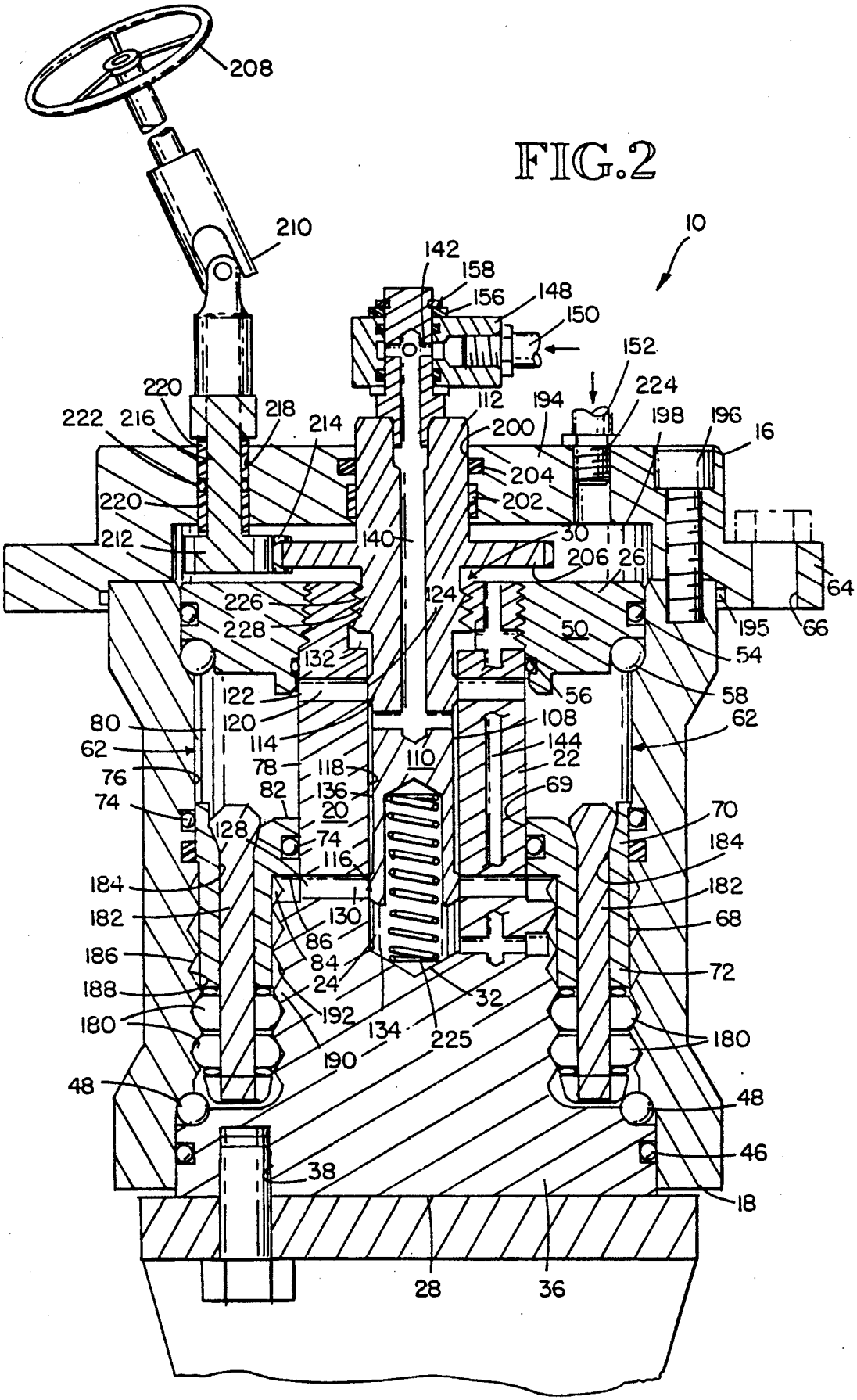
FIG. 2 is a side elevational, sectional view of a first alternative embodiment of the invention of FIG. 1.
Figure 3:
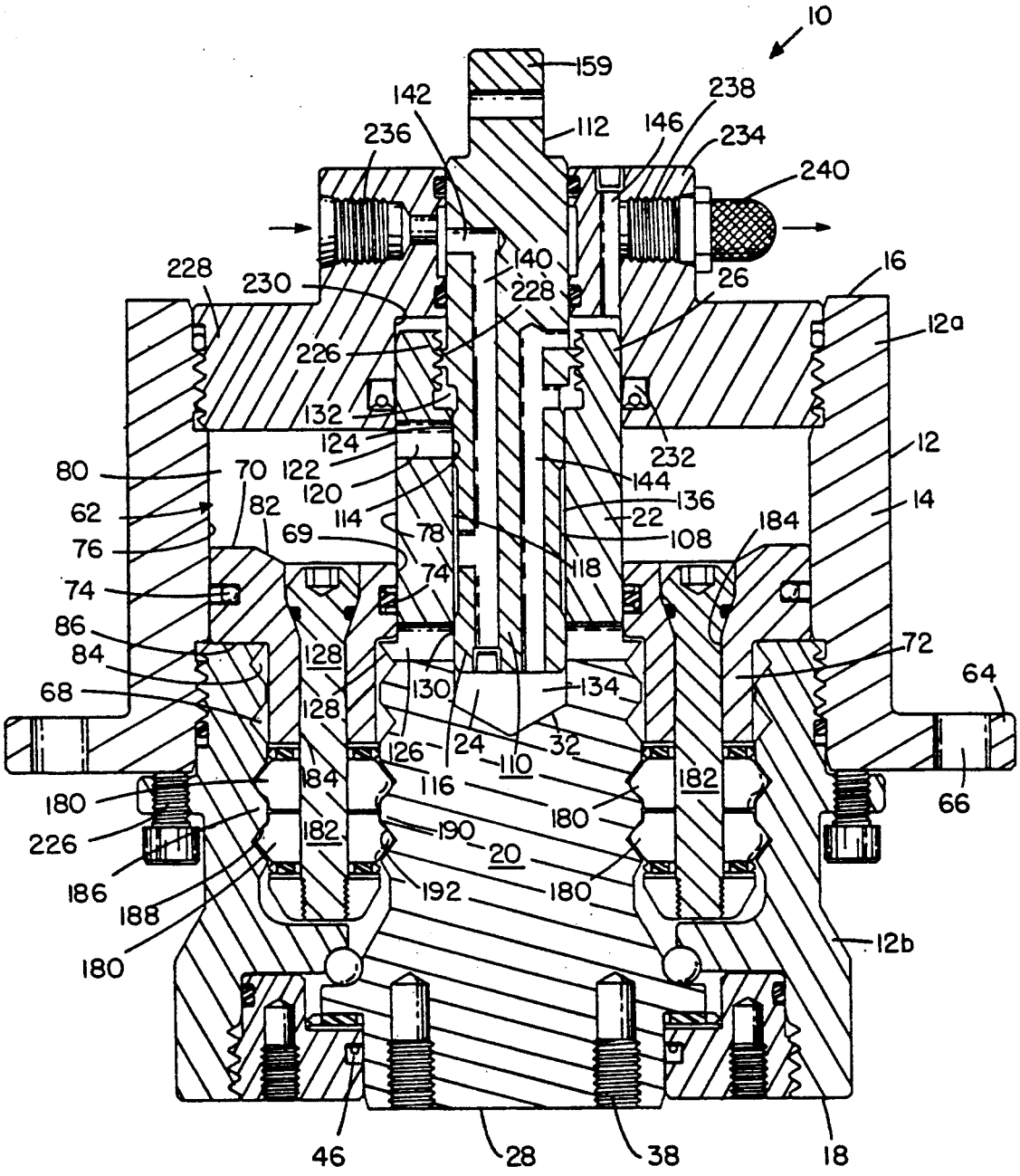
FIG. 3 is a side elevational, sectional view of a second alternative embodiment of the invention of FIG. 1.

Alternative embodiments of the servo actuator 10 are shown in FIGS. 2 and 3. For ease of understanding, the components of the alternative embodiments of the invention described hereinafter will be similarly numbered with those of the embodiment just described when having a similar construction. Only differences in construction will be described in detail.

A first alternative embodiment of the invention is shown in FIGS. 2 and 3. In this embodiment, the servo actuator 10 utilize rollers 180 rotatably retained in fixed axial and circumferential position relative to the piston sleeve 68 by a plurality of shaft spindles 182 as the piston sleeve reciprocates within the body 12. The shaft spindles 182 each has a portion thereof disposed in one of a plurality of circumferentially spaced-apart bore holes 184 formed in the sleeve portion 72 of the piston sleeve 68. The spindles 182 project out of the bore holes 184 into the annular chamber 62, and each spindle has a pair of the rollers 180 mounted thereon. An inward surface portion 186 of the body sidewall 14 toward the second body end 18 has cut therein a plurality of helical grooves 188 which the rollers 180 rollingly engage. Similarly, an outward-facing surface portion 190 of the shaft 20 toward the shaft second end 28 has cut therein a plurality of helical grooves 192 which the rollers 180 also rollingly engage. The helical body grooves 188 have an opposite hand of turn from the helical shaft grooves 192. The rollers 180 roll in the grooves 188 and 192 and eliminate much of the sliding friction experienced by helical splines used in the embodiment of FIG. 1 to provide a more efficient linear-to-rotary conversion means. An actuator using such a roller and groove arrangement is described in detail in U.S. Pat. No. 4,741,250, which is incorporated herein by reference.

In the embodiment of FIG. 2, the body 12 has an end cap 194 at the body first end 16 which is attached to the body first end by a plurality of circumferentially spaced-apart attachment bolts 196. The body end flange 64 is formed as an integral part of the body end cap 194. The body end cap 194 is positioned longitudinally outward of the annular nut 50 to provide a gear chamber 198 therebetween. A conventional seal 195 provides a fluid-tight seal between the body end cap 194 and the body sidewall 14. The valve spool exterior portion 112 projects outward of the body 12 through a central aperture 200 in the body end cap 194. The central aperture 200 of the body end cap 194 is circumferentially grooved to retain a row of radial bearings 202 and a fluid seal 204. The fluid seal 204 provides a fluid-tight seal between the valve spool exterior portion 112 and the body end cap 194.

The valve spool exterior portion 112 has a gear 206 attached thereto positioned within the gear chamber 198 which is used to rotate the valve spool 108 to cause its longitudinal movement within the shaft chamber 24. The spool gear 206 is rotated by turning of a hand wheel 208. The hand wheel 208 is connected through a linkage 210 to a pinion gear 212 positioned within the gear chamber 198. The pinion gear 212 meshes with an idler gear 214, which in turn meshes with the spool gear 206, so that rotation of the hand wheel 208 causes a similar direction of rotation of the spool gear. The linkage 210 220 are disposed in the bore 218 about the shaft 216 to facilitate its rotation. A seal 222 is provided between the shaft 216 and the bore 218 to prevent fluid leakage from the gear chamber 198. The spool valve 108 with the swivel coupling 148 attached thereto is shown separate from the body 12 and shaft 20 in FIG. 3.

In the embodiment of the invention shown in FIG. 2, the hydraulic fluid discharged from the compartments 80 and 84 is ported through the gear chamber 198 to a return port 224 in the body end cap 194. The drain channel 144 in this embodiment extends longitudinally within the wall of the shaft central portion 22 to the gear chamber 198. The discharged fluid lubricates the spool gear 206, the pinion gear 212 and the idler gear 214.

The cam follower 160 and the helical groove 164 which convert relative rotational movement between the valve spool 108 and the shaft 20 into longitudinal movement of the valve spool in the shaft chamber 24 is replaced in the embodiment of FIG. 2 by multi-start interior threads 226 formed on an interior wall portion of the shaft chamber 24 which threadable engage exterior threads formed on the valve portion 110 of the valve spool 108. The threads 226 and 228 are positioned between the gear chamber 198 and the first chamber 132 so that the discharged fluid is on both sides of the threads to provide for their lubrication.

A spring 225 is positioned within the shaft chamber 24 between the valve spool 108 and the closed end 32 of the shaft chamber to apply longitudinally directed force on the valve spool to eliminate backlash.

With the embodiment of FIG. 2, the rotation of the spool gear 206 can alternatively be provided by a stepper motor which is electrically controlled by a user to rotate the valve spool 108 in discrete steps in response to an electrical input. The rotational drive of the stepper motor can be provided to the spool gear 206 through a pinion gear driven by the stepper motor.

A second alternative embodiment of the invention is shown in FIG. 3. In this embodiment, the body 12 is constructed in two halves **12*a* and 12*b* threadably connected together. Lock screws 226 are provided to keep the body halves from rotating relative to each other during operation of the servo actuator 10. In this embodiment, the body half 12*a* has an end cap 228 threadably secured thereto at the body first end 16. The shaft first end 26 projects into a central aperture 230 in the body end cap 228. A fluid seal 232 is provided between the body end cap 228 and the shaft first end 26** to provide a fluid-tight seal therebetween.

The valve spool exterior portion 112 projects through the central aperture 230 outward of the body 12. An annular portion 234 of the body end cap 228 has a fluid supply port 236 in fluid communication with the fluid supply channel 140, and a return port 238 in fluid communication with the drain channel 144. Since the body end cap 228 is stationary with respect to the body 12, no swivel coupling is necessary. In the embodiment of FIG. 3, the servo actuator 10 is shown for operation with compressed air, so the return port 238 has an air filter 240 attached thereto and the "return" air is exhausted to atmosphere through the filter.

While a particular valve spool configuration has been shown and described for the servo actuator 10, alternative designs are usable with the invention. Additionally, alternative arrangements for porting the supply and return fluid to and from the valve spool can be used.

It will be appreciated that, although specific embodiments of the invention have been described herein for purposes of illustration, various modifications may be made without departing from the spirit and scope of the invention. Accordingly, the invention is not limited except as by the appended claims.

I claim:

1. A fluid-powered servo actuator connectable to an external supply of pressurized fluid, comprising:

a generally cylindrical body having a longitudinal axis, and first and second ends;

a drive member extending longitudinally and generally co-axially within said body to define an annular chamber between said body and said drive member, said drive member having first and second ends with said member first end toward said body first end and said member second end toward said body second end, said drive member being supported for rotational movement relative to said body, said member second end being adapted for coupling to an external device to provide rotational drive thereto, said drive member having an interior chamber extending longitudinally and generally coaxial therein and interior of said body, said drive member including a first fluid channel toward said member first end extending between said member chamber and said annular chamber, said first channel having an outward port positioned for fluid communication with said annular chamber toward said member first end, and an inward port positioned for fluid communication with said member chamber toward said member first end, said drive member further including a second fluid channel toward said member second end extending between said member chamber and said annular chamber, said second channel having an outward port positioned for fluid communication with said annular chamber toward said member second end, and an inward port positioned for fluid communication with said member chamber toward said member second end;

an annular piston mounted in said annular chamber between said outward ports of said first and second channels for reciprocal longitudinal movement within said body in response to the selective application of pressurized fluid to a first side thereof toward said body first end from said outward port of said first channel to drive said piston toward said body second end, or to a second side thereof toward said body second end from said outward port of said second channel to drive said piston toward said body first end, said piston having a central aperture through which said drive member projects;

linear-to-rotary means for translating longitudinal movement of said piston toward one of said body first or second ends into clockwise relative rotational movement between said drive member and said body, and translating longitudinal movement of said piston toward the other of said body first or second ends into counterclockwise relative rotational movement between said drive member and said body;

a valve spool positioned in said member chamber, said valve spool being rotatable within said member chamber and longitudinally movable therewithin toward said member first and second ends from a neutral position, said valve spool having a first valve land toward said member first end and a second valve land toward said member second end, said first and second valve lands being in sealing engagement with said drive member as said valve spool moves within said member chamber, said first and second valve lands dividing said member chamber into a first fluid chamber to a side of said first valve land toward said member first end, a second fluid chamber to a side of said second valve land toward said member second end, and a middle fluid chamber between said first and second valve lands, said first valve land being positioned to close said inward port of said first channel and said second valve land being positioned to close said inward port of said second channel when said valve spool is in said neutral position, said valve spool being movable from said neutral position toward said member first end to place said inward port of said first channel in fluid communication with said middle chamber and said inward port of said second channel in fluid communication with said second chamber, and said valve spool being movable from said neutral position toward said member second end to place said inward port of said first channel in fluid communication with said first chamber and said inward port of said second channel in fluid communication with said middle chamber;

a fluid-supply channel extending longitudinally within said valve spool between said middle chamber and a fluid-supply port connectable to the external supply of pressurized fluid;

a drain channel in fluid communication with both said first and second chambers and a drain port for discharge of fluid in said first chamber in response to movement of said piston toward said body first end, and for discharge of fluid in said second chamber in response to movement of said piston toward said body second end; and control means for selectively moving said valve spool longitudinally within said member chamber from said neutral position toward said member first end to apply pressurized fluid in said middle chamber to said piston first side, or toward said member second end to apply pressurized fluid in said middle chamber to said piston second side in response to rotation of said valve spool by a selected amount in a selected direction relative to said drive member, and for longitudinally moving said valve spool back toward said neutral position and positioning said valve spool in said neutral position in response to the resulting rotational movement of said drive member upon said drive member rotating by an amount and in a direction corresponding to said selected amount and direction said valve spool was rotated, whereby when said control means returns said valve spool to said neutral position, said inward ports of said first and second channels are closed by said first and second valve lands, and rotation of said drive member and longitudinal movement of said valve spool ceases until said valve spool is again moved longitudinally within said drive member in response to rotation of said valve spool by the next selected amount and direction.

2. The fluid-powered servo actuator of claim 1 wherein said member chamber has an open end at said member first end and a closed end toward said member second end, and said valve spool projects longitudinally from within said member chamber through said chamber open end to a position exterior of said body at said body first end, said valve spool having a valve spool portion exterior of said body, said fluid-supply port being located at said valve spool exterior portion.

3. The fluid-powered servo actuator of claim 2 further including a swivel fluid connector positioned on said valve spool exterior portion in fluid communication with said fluid-supply port, said swivel connector being rotatable relative to said valve spool exterior portion to permit said swivel connector to remain stationary as said valve spool rotates during operation, said swivel connector being connectable to a fluid line of the external supply of pressurized fluid, whereby the external supply can be connected to the servo actuator with a stationary line unaffected by the rotation of said valve spool.

4. The fluid-powered servo actuator of claim 2 wherein said drain channel extends longitudinally within said valve spool, and said drain port is located at said valve spool exterior portion.

5. The fluid-powered servo actuator of claim 4 further including a swivel fluid connector positioned on said valve spool exterior portion in fluid communication with said fluid-supply and drain ports, said swivel connector being rotatable relative to said valve spool exterior portion to permit said swivel connector to remain stationary as said valve spool rotates during operation, said swivel connector connecting said fluid-supply port to a fluid-supply line and said drain port to a fluid-return line of the external supply of pressurized fluid, whereby the external supply can be connected to the servo actuator with stationary fluid lines unaffected by the rotation of said valve spool.

6. The fluid-powered servo actuator of claim 2 wherein said drain channel is formed in a sidewall of said drive member.

7. The fluid-powered servo actuator of claim 1 wherein said drive member has a circumferential sidewall defining said member chamber therewithin, and said first and second channels extend through said sidewall to communicate fluid between said annular chamber and said member chamber.

8. The fluid-powered servo actuator of claim 1 wherein said control means includes a cam follower connected to said drive member for rotation therewith and a helical groove formed in said valve spool, said cam follower being in engagement with said helical groove to produce longitudinal movement of said valve spool in said member chamber in response to rotation of said valve spool.

9. The fluid-powered servo actuator of claim 1 wherein said control means includes first threads on said valve spool and corresponding second threads on said drive member, said first and second threads being threadably engaged to produce longitudinal movement of said valve spool in said member chamber in response to rotation of said valve spool.

10. The fluid-powered servo actuator of claim 1 further including actuation means for selectively rotating said valve spool relative to said body by said selected amount and direction, whereby when said actuation means is selectively operated said valve spool is rotated relative to said body, and hence said drive member, to cause said control means to move said valve spool longitudinally relative to said drive member from said neutral position.

11. The fluid-powered servo actuator of claim 10 wherein said actuation means includes a gear attached to said valve spool and a corresponding gear in engagement therewith, said corresponding gear being selectively rotatable.

12. The fluid-powered servo actuator of claim 11 using a hydraulic oil as a fluid, wherein said valve spool gear and said corresponding gear are positioned in a gear chamber in said body separate from said annular chamber, and said drain channel is in fluid communication with said gear chamber to supply the discharged fluid thereto for lubrication of said valve spool gear and said corresponding gear during operation.

13. The fluid-powered servo actuator of claim 12 wherein said drive member has a circumferential sidewall defining said member chamber therewith, and said drain channel extends through said sidewall to said gear chamber.

14. The fluid-powered servo actuator of claim 12 wherein said control means is located between said gear chamber and said first chamber, whereby the discharged fluid in said gear chamber is applied to one side and said first chamber is applied to the other side of said control means for lubrication thereof.

15. The fluid-powered servo actuator of claim 11 wherein said corresponding gear is connected to a manually rotatable handwheel.

16. The fluid-powered servo actuator of claim 10 wherein said member chamber has an open end at said member first end and a closed end toward said member second end, and said valve spool projects longitudinally from within said member chamber through said chamber open end to a position exterior of said body at said body first end, said valve spool having a valve spool portion exterior of said body to which said actuation means is connected for selective rotation of said valve spool.

17. The fluid-powered servo actuator of claim 1 wherein said body includes an end cap at said body first end and said member chamber has an open end at said member first end and a closed end toward said member second end, said valve spool projecting longitudinally from within said member chamber through said chamber open end and into an opening in said body end cap, said valve spool having a valve spool portion located in said end cap opening with said fluid-supply port located at said valve spool portion, and said body end cap having a fluid passage in fluid communication with said fluid-supply port and connectable to the external supply of pressurized fluid.

18. A fluid-powered servo actuator connectable to an external supply of pressurized fluid , comprising:

a body having a longitudinal axis, and first and second ends;

a drive member extending longitudinally and generally co-axially within said body to define an annular chamber between said body and said drive member, said drive member having first and second ends with said member first end toward said body first end and said member second end toward said body second end, said drive member being supported for rotational movement relative to said body, said member second end being adapted for coupling to an external device to provide rotational drive thereto, said drive member having a central portion with a circumferential sidewall defining an interior chamber which extends longitudinally within said drive member and interior of said body, said drive member sidewall having a first fluid channel formed therein toward said member first end extending directly between said member chamber and said annular chamber for fluid communication therebetween, and a second fluid channel formed therein toward said member second end extending directly between said member chamber and said annular chamber for fluid communication therebetween;

an annular piston mounted in said annular chamber for reciprocal longitudinal movement within said body in response to the selective application through said first and second channels of pressurized fluid to a first side thereof toward said body first end to drive said piston toward said body second end, and to a second side thereof toward said body second end to drive said piston toward said body first end, said piston having a central aperture through which said drive member central portion projects;

linear-to-rotary means for translating longitudinal movement of said piston toward one of said body first or second ends into clockwise relative rotational movement between said drive member and said body, and translating longitudinal movement of said piston toward the other of said body first or second ends into counterclockwise relative rotational movement between said drive member and said body;

a valve spool positioned in said member chamber, said valve spool being rotatable within said member chamber and longitudinally movable therewithin toward said member first and second ends from a neutral position, said valve spool having a first valve land and a second valve land, said first and second valve lands being in sealing engagement with said drive member sidewall as said valve spool moves within said member chamber, said first valve land being positioned to prevent the flow of fluid through said first channel and said second valve land being positioned to prevent the flow of fluid through said second channel when said valve spool is in said neutral position, said valve spool being movable from said neutral position toward said member first end to place said first channel in fluid communication with a fluid-supply channel and said second channel in fluid communication with a drain channel, and said valve spool being movable from said neutral position toward said member second end to place said first channel in fluid communication with said drain channel and said second channel in fluid communication with said fluid-supply channel;

said fluid-supply channel extending longitudinally within said valve spool and being in fluid communication with a fluid-supply port connectable to the external supply of pressurized fluid;

said drain channel being in fluid communication with a drain port for discharge of fluid from said first side of said piston in response to movement of said piston toward said body first end, and for discharge of fluid from said second side of said piston in response to movement of said piston toward said body second end; and control means for moving said valve spool longitudinally within said member chamber from said neutral position toward said member first end to apply pressurized fluid to said piston first side in response to selected rotation of said valve spool in one direction relative to said drive member, or toward said member second end to apply pressurized fluid to said piston second side in response to selected rotation of said valve spool in an opposite direction relative to said drive member, the amount of longitudinal movement of said valve spool being proportioned to the amount said valve spool is selectively rotated, and for longitudinally moving said valve spool back toward said neutral position and positioning said valve spool in said neutral position in response to the resulting rotational movement of said drive member upon said drive member rotating by an amount and in a direction corresponding to said selected amount and direction said valve spool was rotated, whereby when said control means returns said valve spool to said neutral position, said first and second valve lands prevent the flow of fluids through said first and second channels, and rotation of said drive member and longitudinal movement of said valve spool ceases until said valve spool is again moved longitudinally within said drive member in response to rotation of said valve spool by the next selected amount and direction.

19. The fluid-powered servo actuator of claim 18 wherein said member chamber has an open end at said member first end and a closed end toward said member second end, and said valve spool projects longitudinally from within said member chamber through said chamber open end to a position exterior of said body at said body first end, said valve spool having a valve spool portion exterior of said body, said fluid-supply port being located at said valve spool exterior portion.

20. The fluid-powered servo actuator of claim 19 further including a swivel fluid connector positioned on said valve spool exterior portion in fluid communication with said fluid-supply port, said swivel connector being rotatable relative to said valve spool exterior portion to permit said swivel connector to remain stationary as said valve spool rotates during operation, said swivel connector being connectable to a fluid line of the external supply of pressurized fluid, whereby the external supply can be connected to the servo actuator with a stationary line unaffected by the rotation of said valve spool.

21. The fluid-powered servo actuator of claim 19 wherein said drain channel extends longitudinally within said valve spool, and said drain port is located at said valve spool exterior portion.

22. The fluid-powered servo actuator of claim 19 wherein said drain channel is formed in said drive member sidewall.

23. The fluid-powered servo actuator of claim 18 wherein said control means includes a cam follower rigidly connected to said drive member for rotation therewith and a helical groove formed in said valve spool, said cam follower being in engagement with said helical groove to produce longitudinal movement of said valve spool in said member chamber in response to rotation of said valve spool.

24. The fluid-powered servo actuator of claim 18 wherein said control means includes first threads on said valve spool and corresponding second threads on said drive member, said first and second threads being threadably engaged to produce longitudinal movement of said valve spool in said member chamber in response to rotation of said valve spool.

25. The fluid-powered servo actuator of claim 18 further including actuation means for selectively rotating said valve spool relative to said body by said selected amount and direction, whereby when said actuation means is selectively operated said valve spool is rotated relative to said body, and hence said drive member, to cause said control means to move said valve spool longitudinally relative to said drive member from said neutral position.

26. The fluid-powered servo actuator of claim 25 wherein said actuation means includes a gear attached to said valve spool and a corresponding gear in engagement therewith, said corresponding gear being selectively rotatable.

27. The fluid-powered servo actuator of claim 26 using a hydraulic oil as a fluid, wherein said valve spool gear and said corresponding gear are positioned in a gear chamber in said body separate from said annular chamber, and said drain channel is in fluid communication with said gear chamber to supply the discharged fluid thereto for lubrication of said valve spool gear and said corresponding gear during operation.

28. A fluid-powered servo actuator connectable to an external supply of pressurized fluid, comprising:

a body having a longitudinal axis, and first and second ends;

a drive member extending longitudinally and generally co-axially within said body to define an annular chamber between said body and said drive member, said drive member having first and second ends with said member first end toward said body first end and said member second end toward said body second end, said drive member being supported for rotational movement relative to said body, said member second end being adapted for coupling to an external device to provide rotational drive thereto, said drive member having an interior chamber extending longitudinally and generally coaxial therein and interior of said body, said drive member including a first fluid channel extending between said member chamber and said annular chamber for fluid communication therebetween, and a second fluid channel extending between said member chamber and said annular chamber for fluid communication therebetween;

an annular piston mounted in said annular chamber for reciprocal longitudinal movement within said body in response to the selective application through said first and second channels of pressurized fluid to a first side thereof toward said body first end to drive said piston toward said body second end, and to a second side thereof toward said body second end to drive said piston toward said body first end, said piston having a central aperture through which said drive member projects;

a fluid-supply channel in fluid communication with a fluid-supply port connectable to the external supply of pressurized fluid;

a drain channel in fluid communication with a drain port for discharge of fluid from said first side of said piston in response to movement of said piston toward said body first end, and for discharge of fluid from said second side of said piston in response to movement of said piston toward said body second end;

linear-to-rotary means for translating longitudinal movement of said piston toward one of said body first or second ends into clockwise relative rotational movement between said drive member and said body, and translating longitudinal movement of said piston toward the other of said body first or second ends into counterclockwise relative rotational movement between said drive member and said body;

a valve spool positioned in said member chamber, said valve spool being rotatable within said member chamber and longitudinally movable therewithin toward said member first and second ends from a neutral position, said valve spool having a first valve land and a second valve land, said first and second valve lands being in sealing engagement with said drive member as said valve spool moves within said member chamber, said first valve land being positioned to prevent the flow of fluid through said first channel and said second valve land being positioned to prevent the flow of fluid through said second channel when said valve spool is in said neutral position, said valve spool being movable from said neutral position toward one of said member first or second ends to place said first channel in fluid communication with said fluid-supply channel and said second channel in fluid communication with said drain channel, and said valve spool being movable from said neutral position toward the other one of said member first or second ends to place said first channel in fluid communication with said drain channel and said second channel in fluid communication with said fluid-supply channel; and control means for selectively moving said valve spool longitudinally within said member chamber from said neutral position toward said member first end or toward said member second end in response to rotation of said valve spool by a selected amount in a selected direction relative to said drive member, and for longitudinally moving said valve spool back toward said neutral position and positioning said valve spool in said neutral position in response to the resulting rotational movement of said drive member upon said drive member rotating by an amount and in a direction corresponding to said selected amount and direction said valve spool was rotated, whereby when said control means returns said valve spool to said neutral position, said first and second valve lands prevent the flow of fluid through said first and second channels, and rotation of said drive member and longitudinal movement of said valve spool ceases until said valve spool is again moved longitudinally within said drive member in response to rotation of said valve spool by the next selected amount and direction.

29. A fluid-powered servo actuator connectable to an external supply of pressurized fluid, comprising:

a body having a longitudinal axis, and first and second ends;

a drive member extending longitudinally and generally co-axially within said body to define an annular chamber between said body and said drive member, said drive member having first and second ends with said member first end toward said body first end and said member second end toward said body second end, said drive member being supported for rotational movement relative to said body, said member second end being adapted for coupling to an external device to provide rotational drive thereto, said drive member having an interior chamber extending longitudinally and generally coaxial therein and interior of said body, said drive member including a first fluid channel extending between said member chamber and said annular chamber for fluid communication therebetween, and a second fluid channel extending between said member chamber and said annular chamber for fluid communication therebetween;

an annular piston mounted in said annular chamber for reciprocal longitudinal movement within said body in response to the selective application through said first and second channels of pressurized fluid to a first side thereof toward said body first end to drive said piston toward said body second end, and to a second side thereof toward said body second end to drive said piston toward said body first end, said piston having a central aperture through which said drive member projects;

a fluid-supply channel in fluid communication with a fluid-supply port connectable to the external supply of pressurized fluid;

a drain channel in fluid communication with a drain port for discharge of fluid from said first side of said piston in response to movement of said piston toward said body first end, and for discharge of fluid from said second side of said piston in response to movement of said piston toward said body second end;

linear-to-rotary means for translating longitudinal movement of said piston toward one of said body first or second ends into clockwise relative rotational movement between said drive member and said body, and translating longitudinal movement of said piston toward the other of said body first or second ends into counterclockwise relative rotational movement between said drive member and said body;

a valve spool positioned in said member chamber, said valve spool being rotatable within said member chamber and longitudinally movable therewithin toward said member first and second ends from a neutral position to control the flow of fluid through said first and second channels, said valve spool being movable from said neutral position toward one of said member first or second ends to place said first channel in fluid communication with said fluid-supply channel and said second channel in fluid communication with said drain channel, and said valve spool being movable from said neutral position toward the other of said member first or second ends to place said first channel in fluid communication with said drain channel and said second channel in fluid communication with said fluid-supply channel; and control means for selectively moving said valve spool longitudinally within said member chamber from said neutral position toward said member first end or toward said member second end in response to rotation of said valve spool by a selected amount in a selected direction relative to said drive member, and for longitudinally moving said valve spool back toward said neutral position and positioning said valve spool in said neutral position in response to the resulting rotational movement of said drive member upon said drive member rotating by an amount and in a direction corresponding to said selected amount and direction said valve spool was rotated, whereby when said control means returns said valve spool to said neutral position, rotation of said drive member and longitudinal movement of said valve spool ceases until said valve spool is again moved longitudinally within said drive member in response to rotation of said valve spool by the next selected amount and direction.

* * * * *